US011133130B2

(12) United States Patent
Kawahara et al.

(10) Patent No.: US 11,133,130 B2
(45) Date of Patent: Sep. 28, 2021

(54) PULSE TRANSFORMER

(71) Applicant: TDK CORPORATION, Tokyo (JP)

(72) Inventors: Keisuke Kawahara, Tokyo (JP); Tasuku Mikogami, Tokyo (JP); Setu Tsuchida, Tsuruoka (JP); Toshio Tomonari, Tokyo (JP)

(73) Assignee: TDK CORPORATION, Las Vegas, NV (US)

( * ) Notice: Subject to any disclaimer, the term of this patent is extended or adjusted under 35 U.S.C. 154(b) by 412 days.

(21) Appl. No.: 16/012,611

(22) Filed: Jun. 19, 2018

(65) Prior Publication Data

US 2018/0374632 A1 Dec. 27, 2018

(30) Foreign Application Priority Data

Jun. 23, 2017 (JP) ..... JP2017-123037

(51) Int. Cl.

| | |
|---|---|
| ***H01F 17/04*** | (2006.01) |
| ***H01F 27/29*** | (2006.01) |
| ***H01F 41/076*** | (2016.01) |
| ***H01F 41/069*** | (2016.01) |
| ***H01F 27/38*** | (2006.01) |
| ***H01F 27/24*** | (2006.01) |
| ***H01F 27/28*** | (2006.01) |
| *H01F 19/08* | (2006.01) |

(52) U.S. Cl.

CPC ..... *H01F 27/292* (2013.01); *H01F 17/045* (2013.01); *H01F 27/24* (2013.01); *H01F 27/2823* (2013.01); *H01F 27/38* (2013.01); *H01F 41/069* (2016.01); *H01F 41/076* (2016.01); *H01F 27/2828* (2013.01); *H01F 2019/085* (2013.01)

(58) Field of Classification Search

CPC ..... H01F 17/045; H01F 27/292

See application file for complete search history.

(56) References Cited

U.S. PATENT DOCUMENTS

| | | | | |
|---|---|---|---|---|
| 6,472,969 | B1 * | 10/2002 | Hanato | H01F 17/045 336/192 |
| 2002/0057160 | A1 * | 5/2002 | Hanato | H01F 27/027 336/83 |
| 2006/0071749 | A1 * | 4/2006 | Aoki | H01F 17/045 336/83 |

(Continued)

FOREIGN PATENT DOCUMENTS

| | | | |
|---|---|---|---|
| JP | 2010109267 | A | 5/2010 |
| JP | 2015-222838 | A | 12/2015 |

*Primary Examiner* — Elvin G Enad
*Assistant Examiner* — Malcolm Barnes
(74) *Attorney, Agent, or Firm* — Young Law Firm, P.C.

(57) ABSTRACT

Disclosed herein is a pulse transformer that includes: a drum core including a winding core part and first and second flange parts provided at both ends of the winding core part in an axial direction; a plurality of wires wound around the winding core part; and a plate-like core fixed to the drum core so as to face a first surface of the first flange part that is parallel to the axial direction and a second surface of the second flange part that is parallel to the axial direction. A value of S1/S2 is 0.19 or more and 0.47 or less, where an area of the cross section of the winding core part that is perpendicular to the axial direction is S1 and a facing area between the plate-like core and the first or second surface is S2.

13 Claims, 11 Drawing Sheets

(56) References Cited

U.S. PATENT DOCUMENTS

| | | | | |
|---|---|---|---|---|
| 2010/0109827 | A1 | 5/2010 | Asou et al. | |
| 2014/0292465 | A1* | 10/2014 | Takagi | H01F 27/292 336/192 |
| 2014/0306789 | A1* | 10/2014 | Hirai | H01F 17/045 336/188 |
| 2015/0084731 | A1* | 3/2015 | Takagi | H01F 27/263 336/212 |
| 2015/0287520 | A1* | 10/2015 | Takagi | H01F 27/292 336/170 |
| 2015/0371766 | A1* | 12/2015 | Kawasaki | H01F 27/2823 336/192 |
| 2016/0155561 | A1* | 6/2016 | Takagi | H01F 27/2823 336/222 |
| 2016/0217918 | A1* | 7/2016 | Shiokawa | H01F 27/29 |
| 2016/0365191 | A1* | 12/2016 | Horie | H01F 27/24 |
| 2017/0169927 | A1* | 6/2017 | Miyamoto | H01F 27/2823 |
| 2017/0330672 | A1* | 11/2017 | Uchida | H01F 27/255 |
| 2017/0330676 | A1* | 11/2017 | Uchida | H01F 27/255 |

* cited by examiner

| Sample | S1 ratio | S1/S2 | Inductance (μH) | | | | | IL (dB) | IL ratio |
|---|---|---|---|---|---|---|---|---|---|
| | | | 14 turns | 20 turns | 25 turns | 30 turns | 32 turns | | |
| A 1 | 1 | 0.57 | 58.93 | 120.26 | 187.91 | 270.59 | 307.87 | -0.398 | 1 |
| A 2 | 5/6 | 0.47 | 57.54 | 117.43 | 183.48 | 264.21 | 300.61 | -0.396 | 0.99497487 |
| A 3 | 4/5 | 0.46 | 57.2 | 116.73 | 182.39 | 262.64 | 298.83 | -0.392 | 0.98492462 |
| A 4 | 2/3 | 0.38 | 55.53 | 113.33 | 177.08 | 255 | 290.14 | -0.378 | 0.94974874 |
| A 5 | 1/2 | 0.28 | 52.43 | 107 | 167.19 | 240.75 | 273.92 | -0.354 | 0.88944724 |
| A 6 | 1/3 | 0.19 | 47.08 | 96.08 | 150.13 | 216.19 | 245.97 | -0.3 | 0.75376884 |
| A 7 | 1/4 | 0.14 | 42.68 | 87.11 | 136.11 | 196 | 223 | -0.25 | 0.6281407 |
| A 8 | 1/6 | 0.09 | 35.94 | 73.34 | 114.59 | 165.01 | 187.75 | -0.17 | 0.42713568 |
| A 9 | 1/8 | 0.07 | 31.02 | 63.3 | 98.9 | 142.42 | 162.04 | — | — |
| A 1 0 | 1/10 | 0.06 | 27.28 | 55.67 | 86.98 | 125.25 | 142.5 | — | — |
| A 1 1 | 1/12 | 0.05 | 24.34 | 49.67 | 77.61 | 111.76 | 127.16 | — | — |
| A 1 2 | 1/24 | 0.02 | 14.78 | 30.16 | 47.12 | 67.86 | 77.21 | — | — |

FIG.13

| Sample | S1 ratio | S1/S2 | Inductance (μH) | |
|---|---|---|---|---|
| | | | 20 turns | 32 turns |
| B1 | 1 | 0.43 | 154.19 | 394.71 |
| B2 | 5/6 | 0.36 | 149.05 | 381.56 |
| B3 | 4/5 | 0.34 | 147.8 | 378.38 |
| B4 | 2/3 | 0.28 | 141.85 | 363.13 |
| B5 | 1/2 | 0.21 | 131.16 | 335.76 |
| B6 | 1/3 | 0.14 | 113.81 | 291.35 |
| B7 | 1/4 | 0.11 | 100.44 | 257.12 |
| B8 | 1/6 | 0.07 | 81.27 | 208.04 |
| B9 | 1/8 | 0.05 | 68.22 | 174.63 |
| B10 | 1/10 | 0.04 | 58.77 | 150.45 |
| B11 | 1/12 | 0.04 | 51.62 | 132.14 |
| B12 | 1/24 | 0.02 | 29.82 | 76.34 |

FIG.15

| Sample | S1 ratio | S1/S2 | Inductance (μH) | |
|---|---|---|---|---|
| | | | 20 turns | 32 turns |
| C1 | 1 | 0.43 | 180.1 | 461.05 |
| C2 | 5/6 | 0.36 | 172.49 | 441.57 |
| C3 | 4/5 | 0.34 | 170.67 | 436.92 |
| C4 | 2/3 | 0.28 | 162.1 | 414.98 |
| C5 | 1/2 | 0.21 | 147.19 | 376.8 |
| C6 | 1/3 | 0.14 | 124.16 | 317.85 |
| C7 | 1/4 | 0.11 | 107.29 | 274.67 |
| C8 | 1/6 | 0.07 | 84.32 | 215.85 |
| C9 | 1/8 | 0.05 | 69.42 | 177.73 |
| C10 | 1/10 | 0.04 | 59 | 151.03 |
| C11 | 1/12 | 0.04 | 51.29 | 131.3 |
| C12 | 1/24 | 0.02 | 28.74 | 73.59 |

FIG.16

PULSE TRANSFORMER

BACKGROUND OF THE INVENTION

Field of the Invention

The present invention relates to a pulse transformer and, more particularly, to a surface-mount type pulse transformer using a drum core and a plate-like core.

Description of Related Art

As a surface-mount type pulse transformer using a drum core and a plate-like core, the pulse transformer described in JP 2010-109267 A is known. While the planar size of a pulse transformer is determined according to required characteristics, it is difficult to set the planar size to less than 3 mm square in order to ensure a dielectric strength voltage between primary- and secondary-sides. Thus, a general pulse transformer is often designed to have a size of about 3 mm to about 5 mm long and about 3 mm to about 4 mm wide.

Conventionally, the shape of the drum core is designed so that sufficient magnetic characteristics can be ensured in such a planar size. Specifically, the thickness of a flange part is reduced to some extent in order to ensure a length of a winding core part, while the sectional area of the winding core part is maximized in order to reduce the magnetic resistance of the winding core part.

Insertion loss is one of the characteristics of the pulse transformer. In many cases, insertion loss and inductance are in a trade-off relation, so that it is difficult to reduce insertion loss while ensuring inductance to a certain extent, as far as a conventional drum core shape is concerned.

SUMMARY

It is therefore an object of the present invention to reduce the insertion loss of a pulse transformer while ensuring the inductance to a certain degree.

In order to reduce the insertion loss of a pulse transformer, the winding core part is designed to be thin to reduce the wire length. However, when the thickness of the winding core part is reduced, the magnetic resistance of the winding core part is increased to inevitably reduce the inductance. However, many demonstration experiments made by the present inventors have revealed that the sectional area of the winding core part and insertion loss, and the sectional area of the winding core part and inductance are not simply proportional to each other, but it is possible to reduce the insertion loss while ensuring the inductance to a certain extent when the sectional area of the winding core part falls within a predetermined range in relationship with the facing area between the flange part and a plate-like core.

The present invention has been made based on the above technical knowledge, and a pulse transformer according to the present invention includes: a drum core including a winding core part, a first flange part provided at one end of the winding core part in the axial direction thereof, and a second flange part provided at the other end of the winding core part in the axial direction thereof; a plurality of wires wound around the winding core part; and a plate-like core fixed to the drum core so as to face a first surface of the first flange part that is parallel to the axial direction and a second surface of the second flange part that is parallel to the axial direction. Assuming that the area of the cross section of the winding core part that is perpendicular to the axial direction is S1 and that the facing area between the plate-like core and the first or second surface is S2, the value of S1/S2 is 0.19 or more and 0.47 or less.

The value of S1/S2 in a general pulse transformer is 0.5 or more, while the value of S1/S2 in the pulse transformer according to the present invention is less than 0.47, so that the length of the wire is reduced to make it possible to reduce insertion loss more than in a general pulse transformer. In addition, the value of S1/S2 is set to 0.19 or more, a reduction in inductance can be suppressed to, e.g., 20% or less.

In the present invention, the value of S1/S2 may be 0.38 or less. This can reduce the insertion loss by, e.g., 5% or more than in a general transformer.

In the present invention, the value of S1/S2 may be 0.21 or more. That is, by making the thickness of the flange part larger than that in a general transformer, a reduction in inductance can be prevented. Further, when the thickness of the winding core part is small, if the thickness of the flange part is large, the winding core part is liable to be easily broken; however, when the value of S1/S2 is set to 0.21 or more, the breakage of the winding core part can be prevented.

In the present invention, the drum core may have a length of 3 mm or more and 5 mm or less in the axial direction and a width of 3 mm or more and 4 mm or less in a first direction crossing the axial direction and parallel to the first and second surfaces. The present invention can suitably be applied to such a small-sized pulse transformer.

In the present invention, the value of S1 may be 0.85 $mm^2$ or more and less than 1.43 $mm^2$. Generally, in a small-sized pulse transformer having the above planar size, the value of S1 is about 1.7 $mm^2$, while when the value of S1 is set in the above range, it is possible to reduce the insertion loss while ensuring the inductance to a certain extent.

The pulse transformer according to the present invention may further include a pair of primary-side signal terminals and a secondary-side center tap which are formed on the first flange part and a pair of secondary-side signal terminals and a primary-side center tap which are formed on the second flange part. One end of each of the plurality of wires may be connected to any one of the pair of primary-side signal terminals and the secondary-side center tap, and the other end of each of the plurality of wires may be connected to any one of the pair of secondary-side signal terminals and the primary-side center tap. In a pulse transformer having such a configuration, the primary-side terminal and secondary-side terminal coexist in the same flange part, so that the flange part needs to have a certain thickness in order to ensure a dielectric strength voltage. The present invention can be applied to a pulse transfer having such a configuration.

In the present invention, the height of the winding core part in a second direction crossing the axial direction and first direction may be larger than the width of the winding core part in the first direction. This makes the winding core part less likely to be broken at manufacturing or mounting.

As described above, according to the present invention, it is possible to reduce the insertion loss of a pulse transformer while ensuring the inductance to a certain extent.

BRIEF DESCRIPTION OF THE DRAWINGS

The above and other objects, features and advantages of this invention will become more apparent by reference to the following detailed description of the invention taken in conjunction with the accompanying drawings, wherein:

FIG. 13 is a table indicating simulation results of samples A1 to A12;

FIG. 15 is a table indicating simulation results of samples B1 to B12; and

FIG. 16 is a table indicating simulation results of samples C1 to C12.

DETAILED DESCRIPTION OF THE EMBODIMENTS

Preferred embodiments of the present invention will now be explained in detail with reference to the drawings.

Figure 1:
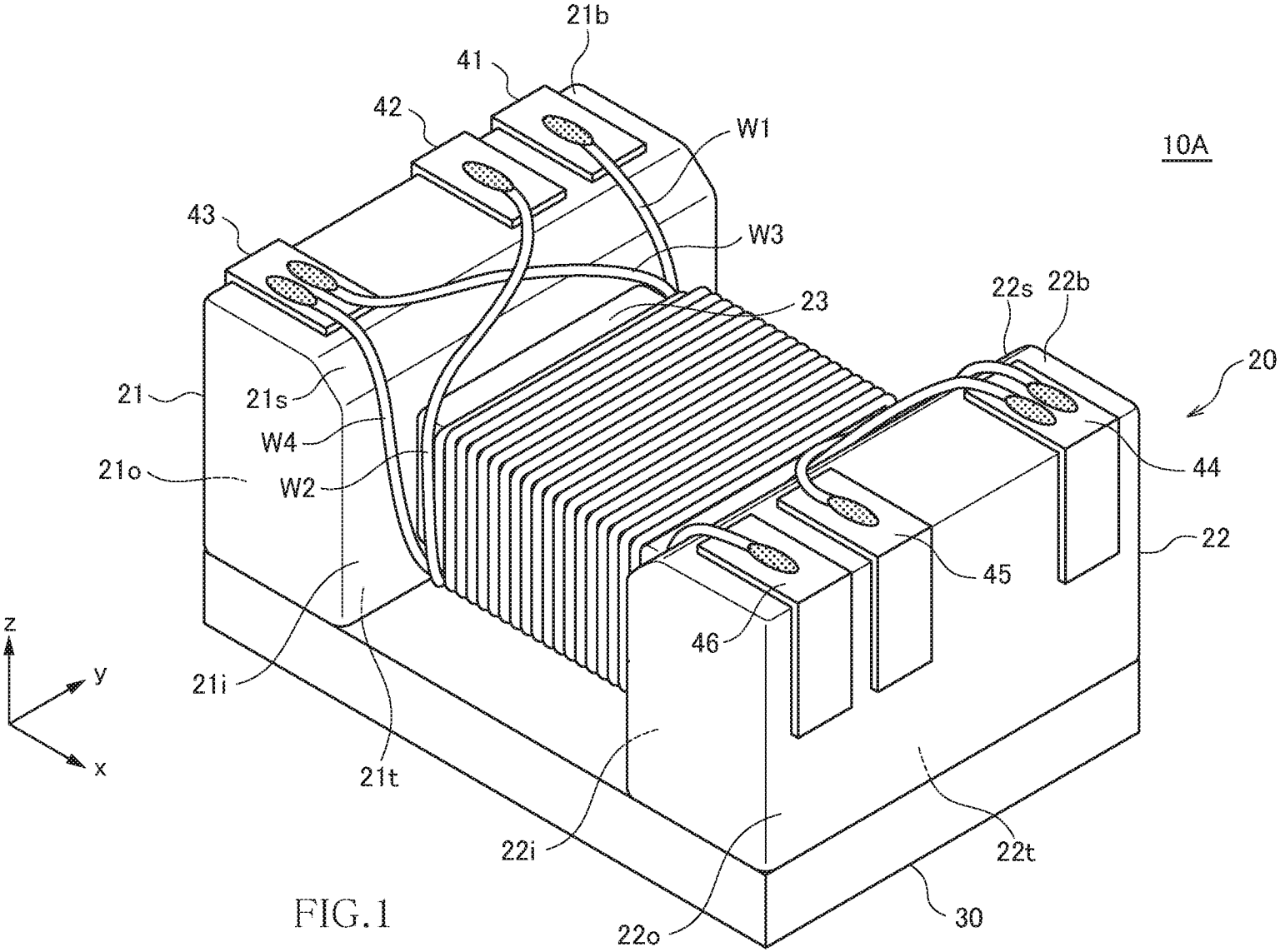
FIG. 1 is a schematic perspective view illustrating the outer appearance of a pulse transformer according to a first embodiment of the present invention.
Figure 2:
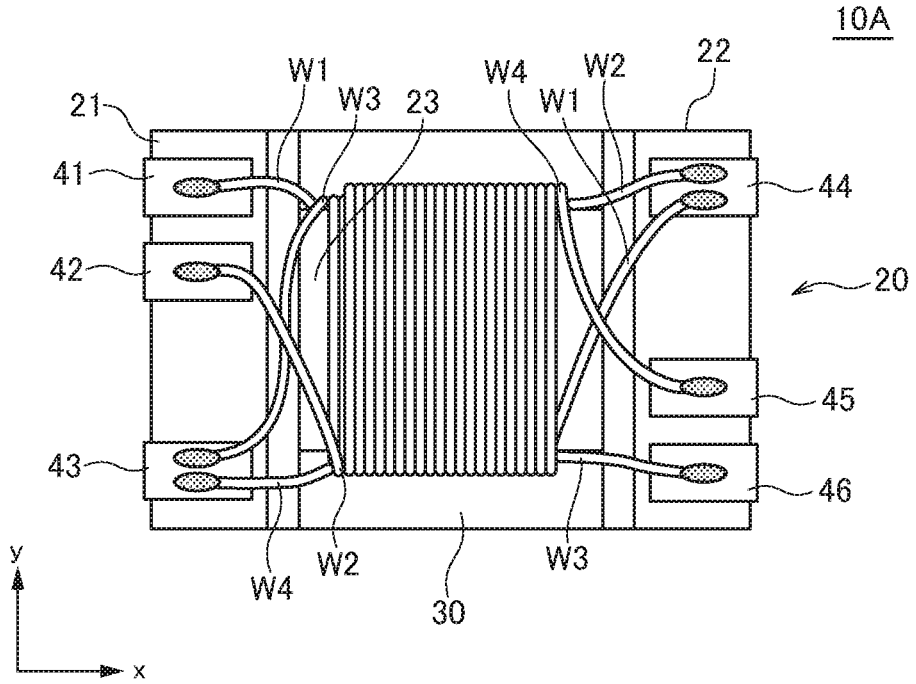
FIG. 2 is a plan view of the pulse transformer shown in FIG. 1.

FIG. 1 is a schematic perspective view illustrating the outer appearance of a pulse transformer 10A according to the first embodiment of the present invention. FIG. 2 is a plan view of the pulse transformer 10A.

As illustrated in FIGS. 1 and 2, the pulse transformer 10A according to the present embodiment has a drum core 20, a plate-like core 30, six terminal electrodes 41 to 46, and four wires W1 to W4.

The drum core 20 includes a winding core part 23, a first flange part 21 provided at one end of the winding core part 23 in the axial direction (x-direction) thereof, and a second flange part 22 provided at the other end of the winding core part 23 in the axial direction. The drum core 20 is a block made of a high permeability material such as ferrite and has a configuration in which the flange parts 21 and 22 and the winding core part 23 are formed integrally. While the yz cross section (cross section perpendicular to the axial direction) of the winding core part 23 has a rectangular shape, the corners thereof are chamfered by barrel polishing. The cross section of the winding core part 23 need not necessarily be rectangular but may have other shapes, e.g., a polygonal shape other than a rectangle, such as a hexagon or an octagon. Further, the winding core part 23 may have partly a curved surface.

The first flange part 21 has an inside surface 21*i* connected to the winding core part 23, an outside surface 210 positioned on the side opposite to the inside surface 21*i*, a bottom surface 21*b* facing a substrate at mounting, and a surface 21*t* positioned on the side opposite to the bottom surface 21*b*. The inside surface 21*i* and outside surface 210 each constitute the yz plane, and the bottom surface 21*b* and the surface 21*t* each constitute the xy plane. Similarly, the second flange part 22 has an inside surface 22*i* connected to the winding core part 23, an outside surface 22*o* positioned on the side opposite to the inside surface 22*i*, a bottom surface 22*b* facing the substrate at mounting, and a surface 22*t* positioned on the side opposite to the bottom surface 22*b*. The inside surface 22*i* and the outside surface 22*o* each constitute the yz plane, and the bottom surface 22*b* and the top surface 22*t* each constitute the xy plane. In the present embodiment, the corner between the bottom surface 21*b* and the inside surface 21*i* of the first flange part 21 is chamfered into a slope 21*s*. Similarly, the corner between the bottom surface 22*b* and inside surface 22*i* of the second flange part 22 is chamfered into a slope 22*s*.

The plate-like core 30 is bonded to the surface 21*t* of the first flange part 21 and the surface 22*t* of the second flange part 22. The plate-like core 30 is a plate-like body made of a high permeability material such as ferrite and constitutes a closed magnetic path together with the drum core 20. The plate-like core 30 may be made of the same material as that of the drum core 20. The plate-like core 30 may be directly bonded to the drum core 20 by an adhesive or may be indirectly bonded to the drum core 20 with the wires W1 to W4 and the plate-like core 30 bonded to each other by an adhesive.

As illustrated in FIGS. 1 and 2, three terminal electrodes 41 to 43 are provided on the first flange part 21. The terminal electrodes 41 to 43 are arranged in this order in the y-direction and each have an L-like shape that covers the bottom surface 21*b* and the outside surface 21*o*. The first terminal electrode 41 is connected with one end of the first wire W1, the second terminal electrode 42 is connected with one end of the second wire W2, and the third terminal electrode 43 is connected with one ends of the third wires W3 and W4.

Similarly, three terminal electrodes 44 to 46 are provided on the second flange part 22. The terminal electrodes 44 to 46 are arranged in this order in the y-direction and each have an L-like shape that covers the bottom surface 22*b* and the outside surface 22*o*. The fourth terminal electrode 44 is connected with the other ends of the first and second wires W1 and W2, the fifth terminal electrode 45 is connected with the other end of the fourth wire W4, and the sixth terminal electrode 46 is connected with the other end of the third wire W3.

The terminal electrodes 41 to 46 may each be a terminal metal fitting bonded to the drum core 20 or may each be directly formed on the drum core 20 using a conductive paste.

Figure 3:
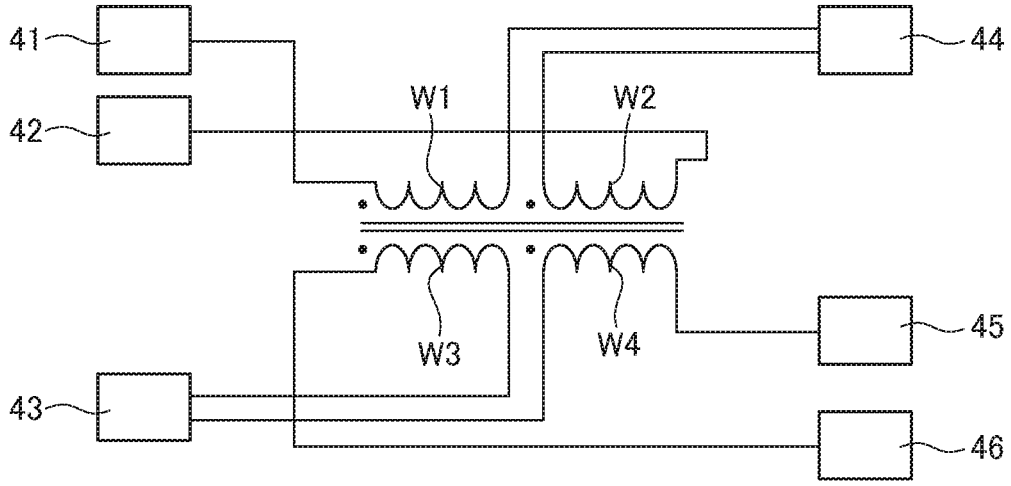
FIG. 3 is an equivalent circuit diagram of the pulse transformer shown in FIG. 1.

The first and third wires W1 and W3 and the second and fourth wires W2 and W4 are wound in the opposite directions. Thus, as illustrated in the circuit diagram of FIG. 3, a pulse transformer is constituted, in which the first and second terminal electrodes 41 and 42 function as a pair of primary-side terminals, the fifth and sixth terminal electrodes 45 and 46 function as a pair of secondary-side terminals, the fourth terminal electrode 44 functions as a primary-side center tap, and the third terminal electrode 43 functions as a secondary-side center tap. Here, the primary side and secondary side are defined conveniently, and they may be reversed.

The first and second terminal electrodes 41 and 42 constituting the pair of primary-side terminals are terminals that input thereto or output a pair of differential signals. The connection relationship between the first and second terminal electrodes 41 and 42 and first and second wires W1 and W2 is not limited to that illustrated in FIGS. 1 to 3 and may be reversed. Similarly, the fifth and sixth terminal electrodes 45 and 46 constituting the pair of secondary-side terminals are terminals that input thereto or output a pair of differential signals. The connection relationship between the fifth and sixth terminal electrodes 45 and 46 and the third and fourth wires W3 and W4 is not limited to that illustrated in FIGS. 1 to 3 and may be reversed.

While the planar size of the drum core 20 is not particularly limited, it is difficult to reduce the width thereof at least in the y-direction to less than a predetermined value since the primary- and secondary-side terminals coexist in the same flange part. Specifically, the primary-side terminal and the secondary-side terminal (i.e., the terminal electrodes 42 and 43 or terminal electrodes 44 and 45) need to be spaced apart from each other by about 1.5 mm in the y-direction from the view point of ensuring a dielectric strength voltage. Taking this into consideration, it is difficult to reduce the width of the drum core 20 in the y-direction to less than 3 mm. Meanwhile, electronic components are required to be miniaturized as much as possible, so that the width of the drum core 20 in the y-direction is preferably 3 mm or more and 4 mm or less.

The length of the drum core 20 in the x-direction is preferably equal to or slightly larger than the width of the drum core 20 in the y-direction in consideration of mounting efficiency on a circuit board. Thus, the width of the drum core 20 in the x-direction is preferably 3 mm or more and 5 mm or less. As one example, the length of the drum core 20 in the x-direction can be set to 4.5 mm, and the width of the drum core 20 in the y-direction can be set to 3.2 mm. As another example, the length of the drum core 20 in the x-direction can be set to 3.2 mm, and the width of the drum core 20 in the y-direction can be set to 3.2 mm.

The following describes more specifically the shape of the drum core 20 constituting the pulse transformer 10A.

Figure 4:
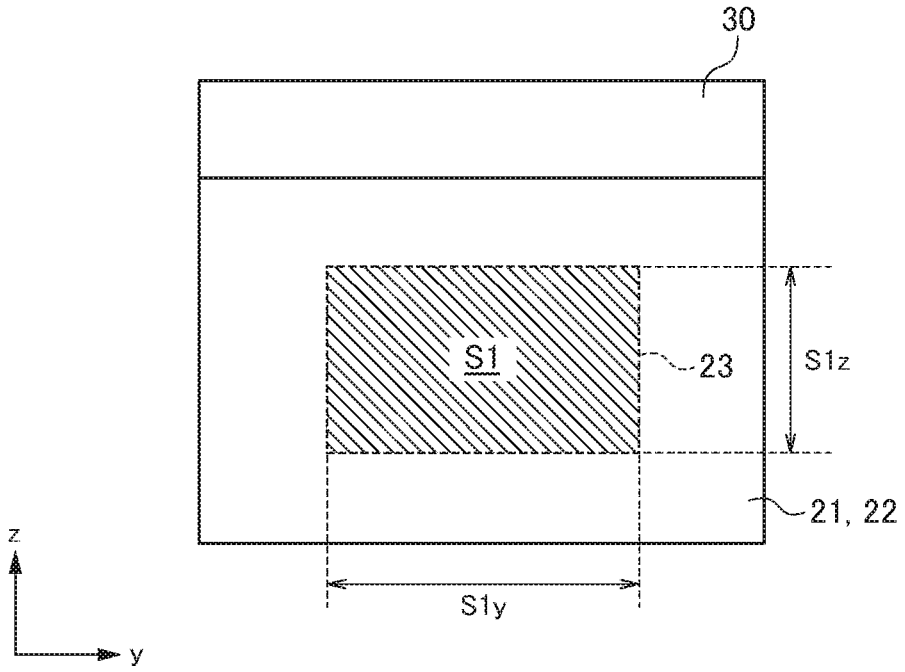
FIG. 4 is a diagram for explaining an area S1.

The drum core 20 used in the present embodiment has the following characteristics in terms of the shape thereof. First, as illustrated in FIG. 4, the area of the yz cross section of the winding core part 23, i.e., the area of the cross section of the winding core part 23 perpendicular to the x-direction (axial direction) is defined as S1. The area S1 can be calculated by the product of a width S1*y* in the y-direction and a height S1*z* in the z-direction when the yz cross section of the winding core part 23 is substantially rectangular. When the sectional area of the winding core part 23 is not constant in the axial direction, for example, when the sectional area is slightly increased in the vicinity of the flange part, or when a concave or a convex portion exists in the surface of the winding core part, the average of the values of the sectional area in the axial direction is defined as the area S1.

Figure 5:
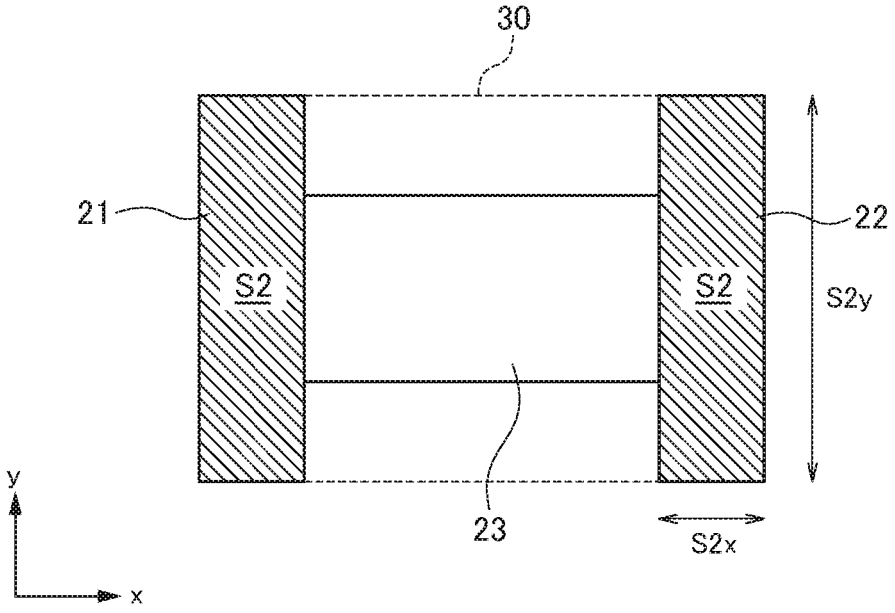
FIG. 5 is a diagram for explaining an area S2.

Further, as illustrated in FIG. 5, the facing area between the surface 21*t* of the first flange part 21 or the surface 22*t* of the second flange part 22 and the plate-like core 30 is defined as S2. The area S2 can be calculated by the product of a width S2*y* in the y-direction and a thickness S2*x* in the x-direction when the xy shapes of the surfaces 21*t* and 22*t* of the first and second flange parts 21 and 22 are substantially rectangular. When there is a difference in area between the surface 21*t* of the first flange part 21 and the surface 22*t* of the second flange part 22, the average value between them is defined as the area S2.

Figure 6:
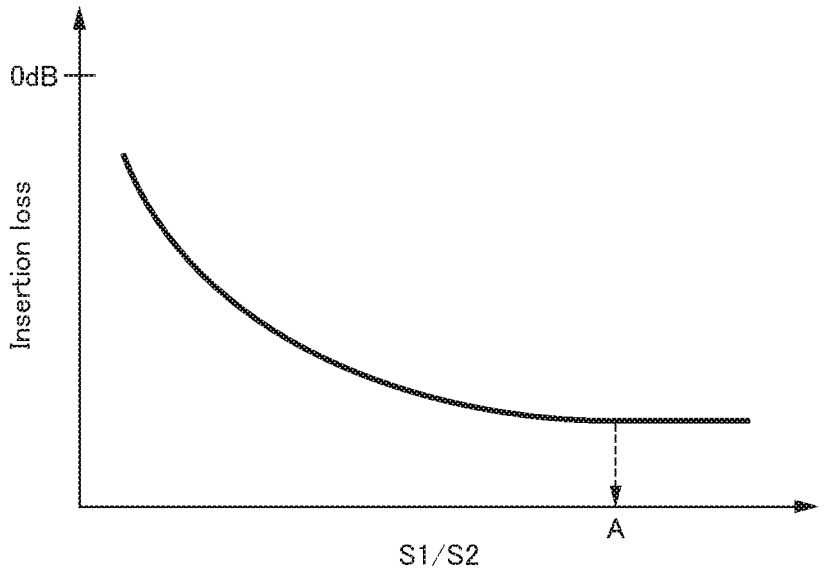
FIG. 6 is a schematic graph for explaining the relationship between the value of S1/S2 and insertion loss.

FIG. 6 is a schematic graph for explaining the relationship between the value of S1/S2 and insertion loss. On the vertical axis of FIG. 6, the point of 0 dB denotes a state where no insertion loss is caused, and as the vertical axis goes downward, the insertion loss is increased (that is, signal component is more attenuated due to the insertion loss).

The graph of FIG. 6 reveals that the insertion loss is reduced as the value of S1/S2 becomes small. This is because a reduction in the area S1 reduces the thickness of the winding core part 23 and, correspondingly, the entire length of each of the wires W1 to W4 is reduced. However, the relationship between the value of S1/S2 and the insertion loss is not linear, and even when the value of S1/S2 is reduced, the insertion loss is hardly reduced in a range equal to or more than the value A illustrated in FIG. 6. When the S1/S2 is set to a value less than the value A, the insertion loss is significantly reduced. Thus, to reduce the insertion loss significantly, it is necessary to set the S1/S2 to a value less than the value A.

Although the value A slightly varies depending on the planar size of the drum core 20, a concrete value thereof falls within a range of 0.4 or more to less than 0.5 in a drum core of general size. In particular, when the length of the drum core 20 in the x-direction is 3 mm or more and 5 mm or less, and the width there of in the y-direction is 3 mm or more and 4 mm or less, the value A becomes about 0.47. On the other hand, in a general pulse transformer, the width S1*y* of the winding core part 23 in the y-direction is about half the width S2*y* of each of the flange parts 21 and 22 in the y-direction, and the height S1*z* of the winding core part 23 in the z-direction is equal to or slightly larger than the thickness S2*x* of each of the flange parts 21 and 22 in the x-direction. Thus, the value of S1/S2 in a general pulse transformer falls within a range of about 0.5 to about 0.6.

Figure 7:
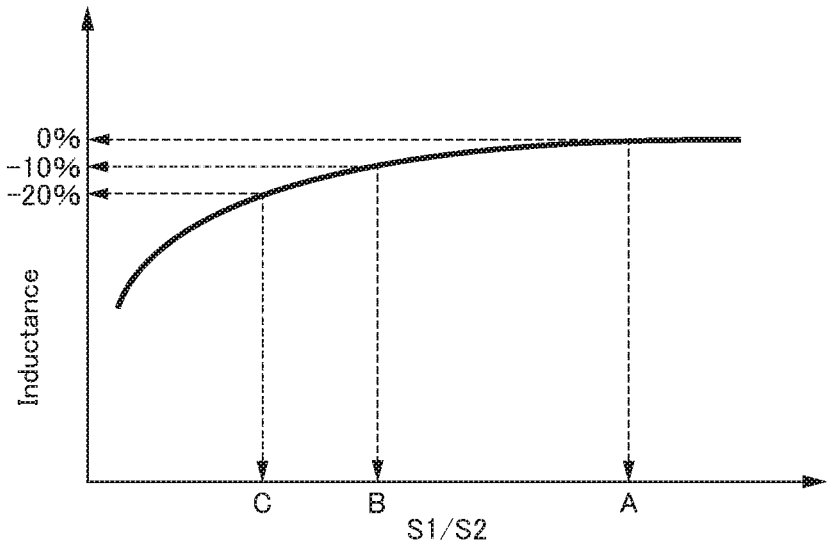
FIG. 7 is a schematic graph for explaining the relationship between the value of S1/S2 and inductance.

FIG. 7 is a schematic graph for explaining the relationship between the value of S1/S2 and inductance. The graph of FIG. 7 reveals that the inductance becomes smaller as the value of S1/S2 smaller. This is because a reduction in the area S1 reduces the thickness of the winding core part 23 and, correspondingly, the magnetic resistance of the winding core part 23 is increased. However, the relationship between the value of S1/S2 and the inductance is not linear, and even when the value of S1/S2 is reduced, a change in the inductance with respect to a change in the S1/S2 is gentle in the vicinity of the value A illustrated in FIG. 7. Note that the value A in FIG. 7 is equal to the value A in FIG. 6. As the S1/S2 is reduced from the value A, reduction in the inductance gradually becomes more conspicuous. Then, when the S1/S2 reaches the value B, the inductance is reduced by 10% as compared with the inductance at the value A, and when the S1/S2 reaches the value C, the inductance is reduced by 20% as compared with the inductance at the value A.

The reduction in the inductance can be compensated by increasing the number of turns of each of the wires W1 to W4, whereas the increase in the number of turns increases the insertion loss. In this view, some reduction in the inductance can be tolerated, but it is difficult to tolerate a reduction exceeding 20%. Further, when the S1/S2 becomes smaller than the value C, a change in the inductance with respect to a change in the S1/S2 becomes large, with the result that a change in the inductance due to manufacturing variations becomes conspicuous. Taking this into consideration, it is necessary to set the S1/S2 equal to or more than the value C.

Although the value C slightly varies depending on the planar size of the drum core 20, a concrete value thereof falls within a range of 0.15 or more to less than 0.20 in a drum core of general size. In particular, when the length of the drum core 20 in the x-direction is 3 mm or more and 5 mm or less, the width thereof in the y-direction is 3 mm or more and 4 mm or less, and the thickness of each of the flange parts 21 and 22 in the x-direction is about 0.9 mm, the value C becomes about 0.19.

Figure 8:
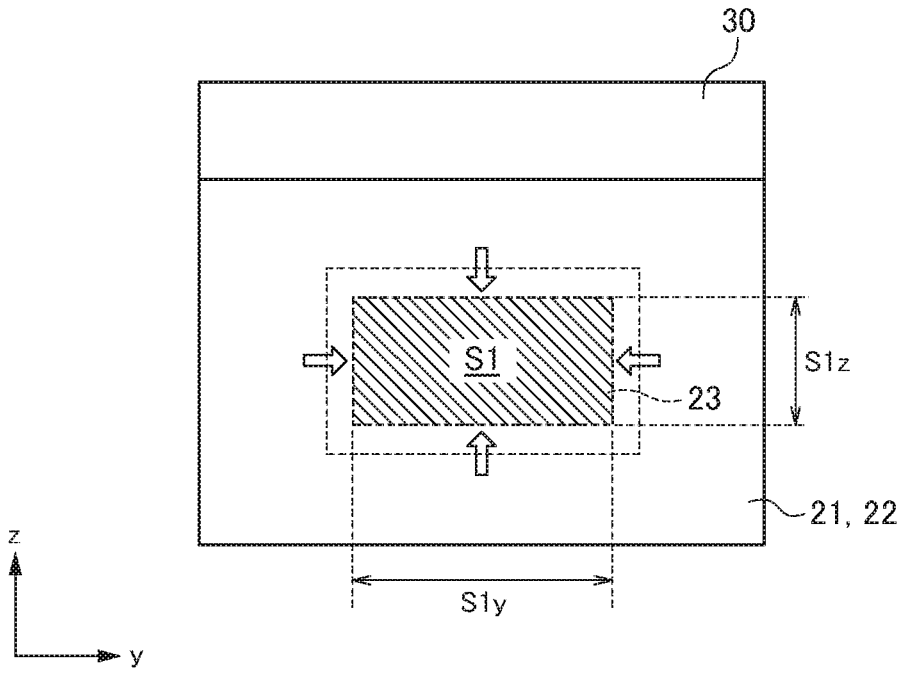
FIG. 8 is a diagram for explaining a first method to decrease the value of S1/S2.
Figure 9:
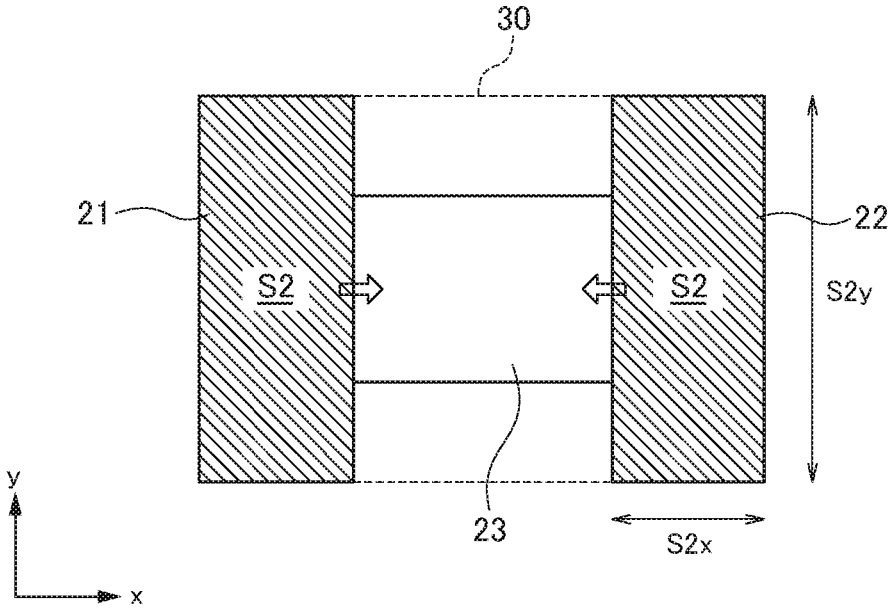
FIG. 9 is a diagram for explaining a second method to decrease the value of S1/S2.

To reduce the value of S1/S2, as illustrated in FIG. 8, a method of reducing the yz cross section (i.e., area S1) of the winding core part 23 of the drum core 20 is most effective. This allows the value of S1/S2 to be reduced without changing the area S2. However, a reduction in the area S1 increases the magnetic resistance of the winding core part 23, with the result that the inductance is reduced as described using FIG. 7. When there is a need to compensate this, the area S2 may be increased as illustrated in FIG. 9, in addition to the reduction in the area S1, to reduce the magnetic resistance of the winding core part 23. In the example of FIG. 9, the length of the winding core part 23 in the x-direction is reduced without changing the length of the entire drum core 20 in the x-direction to thereby increase the thickness S2*x* of each of the flange parts 21 and 22. According to this method, it is possible to increase the area S2 without changing the planar size of the pulse transformer 10A.

Figure 10:
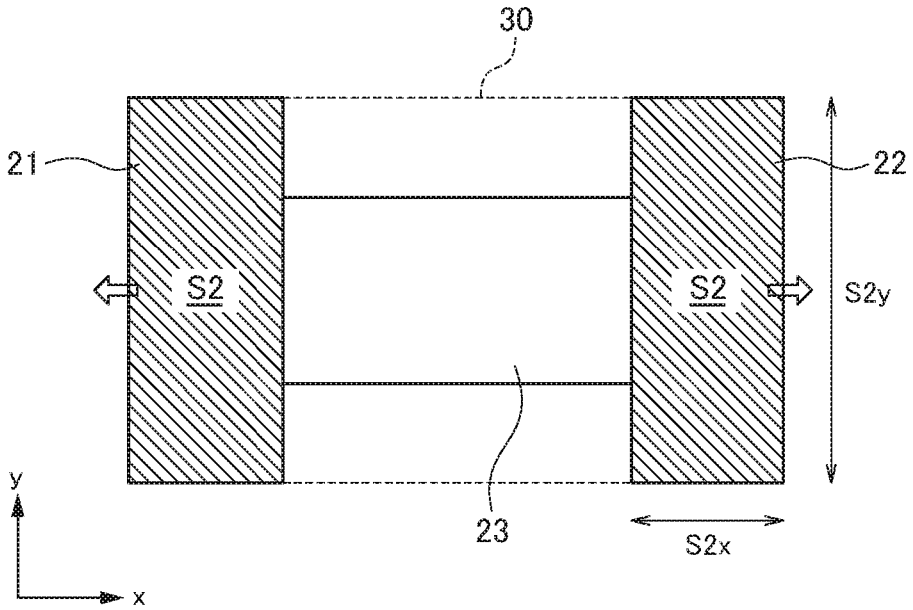
FIG. 10 is a diagram for explaining a third method to decrease the value of S1/S2.

Alternatively, as illustrated in FIG. 10, it is possible to increase the thickness S2*x* of each of the flange parts 21 and 22 in the x-direction without changing the length of the winding core part 23 in the x-direction so as to increase the area S2. This method allows the length of the winding core part 23 to be maintained and is thus effective when the winding core part 23 needs to have a certain length due to a large number of turns of each of the wires W1 to W4. Further alternatively, the width S2*y* of each of the flange parts 21 and 22 in the y-direction may be increased so as to increase the area S2.

Figure 11:
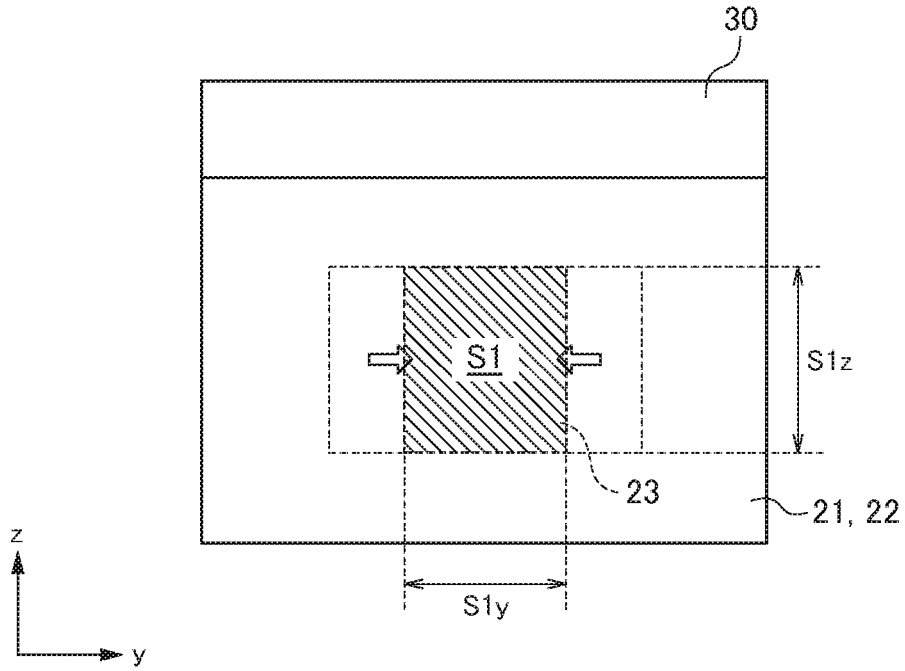
FIG. 11 is a diagram for explaining a fourth method to decrease the value of S1/S2.

On the other hand, to reduce the area S1, as illustrated in FIG. 11, it is possible to adopt a method of not wholly reducing but selectively reducing the width S1*y* of the winding core part 23 in the y-direction to thereby bring the yz cross section of the winding core part 23 close to a square shape. According to this method, a reduction in mechanical strength due to the reduction in the thickness of the winding core part 23 can be suppressed, thereby making the winding core part 23 less liable to be broken. Breakage due to the reduction in the thickness of the winding core part 23 often occurs when a force from the z-direction is applied to the winding core part 23 at the time of connection of the wires W1 to W4 or at the time of mounting to a circuit board. Thus, by making the height S1*z* of the winding core part 23 in the z-direction larger than the width S1*y* of the winding core part 23 in the y-direction, it is possible to effectively prevent the breakage of the winding core part 23 due to a force from the z-direction.

As described above, in the pulse transformer 10A according to the present embodiment, the value of S1/S2 is less than the value A that is considerably smaller than that in a general pulse transformer, thus allowing the insertion loss to be reduced. In addition, the S1/S2 is set to the value C or more, thus making it possible to minimize a reduction in the inductance and to ensure mechanical strength.

Figure 12:
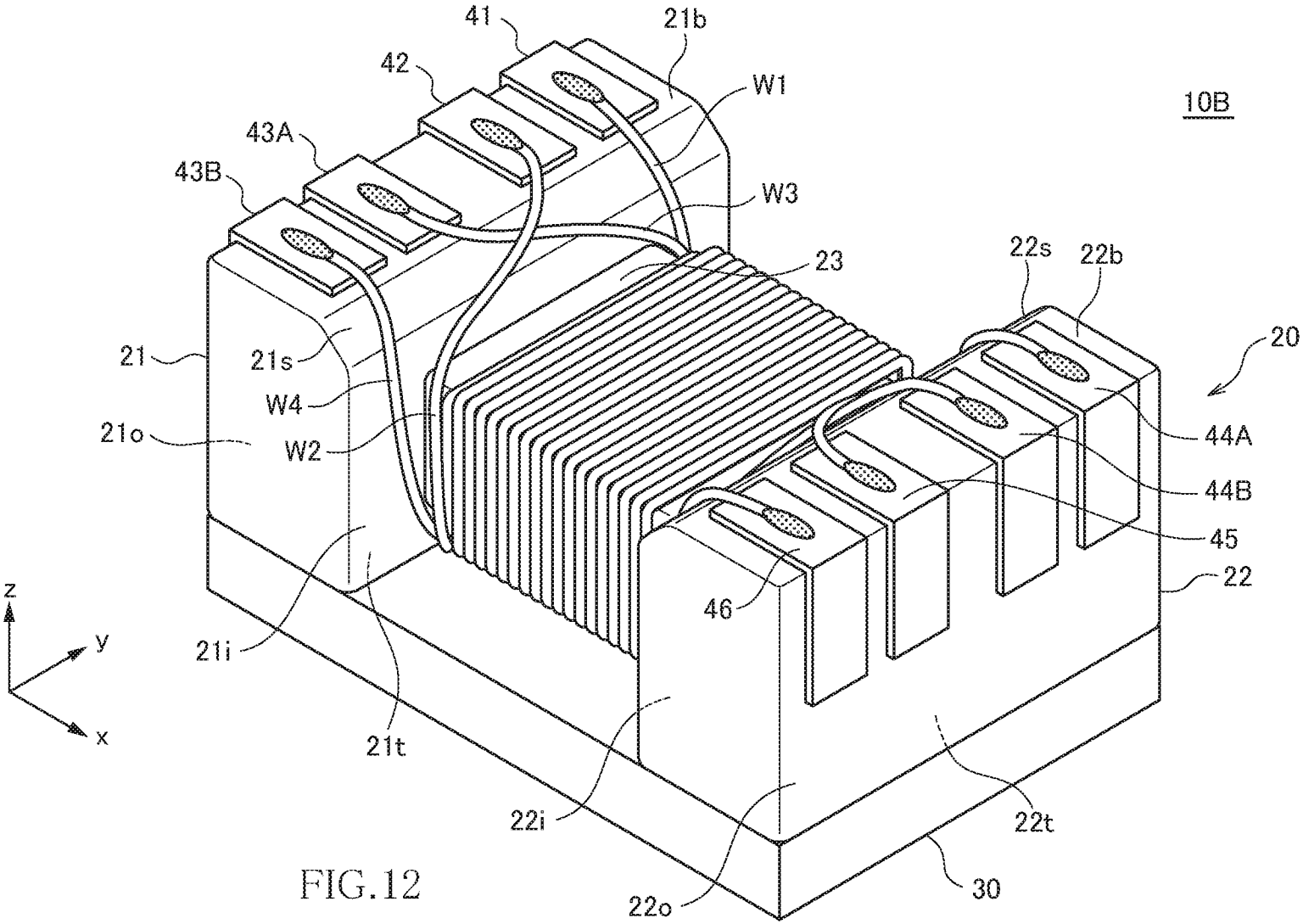
FIG. 12 is a schematic perspective view illustrating the outer appearance of a pulse transformer according to a second embodiment of the present invention.

FIG. 12 is a schematic perspective view illustrating the outer appearance of a pulse transformer 10B according to the second embodiment of the present invention.

As illustrated in FIG. 12, the pulse transformer 10B according to the second embodiment differs from the pulse transformer 10A according to the first embodiment in that the terminal electrode 43 is divided into two terminal electrodes 43A and 43B and the terminal electrode 44 is divided into two terminal electrodes 44A and 44B. Other configurations are the same as those of the pulse transformer 10A according to the first embodiment, so the same reference numerals are given to the same elements, and overlapping description will be omitted.

In the present embodiment, one ends of the third and fourth wires W3 and W4 are connected respectively to the terminal electrodes 43A and 43B, and the other ends of the second and first wires W2 and W1 are connected respectively to the terminal electrodes 44A and 44B.

The terminal electrodes 43A and 43B constitute a secondary-side center tap and are short-circuited on a circuit board on which the pulse transformer 10B is mounted. The terminal electrodes 44A and 44B constitute a primary-side center tap and are short-circuited on the circuit board on which the pulse transformer 10B is mounted. As a result, the same circuit configuration as that of the pulse transformer 10A according to the first embodiment can be obtained. The connection relationship between the terminal electrodes 43A, 43B and the wires W3, W4 may be inverted. Similarly, the connection relationship between the terminal electrodes 44A, 44B and the wires W2, W1 may be inverted.

As exemplified in the present embodiment, in the present invention, the number of the terminal electrodes to be formed on each of the first and second flange parts 21 and 22 need not necessarily be three but may be four.

It is apparent that the present invention is not limited to the above embodiments, but may be modified and changed without departing from the scope and spirit of the invention.

EXAMPLES

Samples A1 to A12 of pulse transformers each having the similar configuration to that of the pulse transformer 10A illustrated in FIG. 1 were assumed, and values of inductance and insertion loss (IL) were simulated. The number of turns per wire was set to five different values: 14, 20, 25, 30, and 32 for each of the samples A1 to A12.

In all the samples A1 to A12, the drum core had an x-direction length of 4.5 mm, a y-direction width of 3.34 mm, and a z-direction height of 1.58 mm, and the plate-like core had an x-direction length of 4.5 mm, a y-direction width of 3.34 mm, and a z-direction height of 1.07 mm. Further, in all the samples A1 to A12, the thickness S2*x* of the flange part in the x-direction was 0.9 mm. Accordingly, in all the samples A1 to A12, the area S2 was 3.006 $mm^2$ (=0.9 mm×3.34 mm).

In the sample A1, the width S1*y* of the winding core part in the y-direction was set to 1.6 mm, and the height S1*z* of the winding core part in the z-direction was set to 1.07 mm. That is, in the sample A1, the area S1 was 1.712 $mm^2$ (=1.6 mm×1.07 mm), and the value of S1/S2 was about 0.57 (given as rounding at triple figures below decimal point). The above sample A1 has the shape and size of a typical pulse transformer. On the other hand, the samples A2 to A12 are samples obtained by reducing the sectional area (S1) of the winding core part of the sample A1. The sectional area of the winding core part was reduced in the same proportion in the y- and z-directions. Thus, the cross-sectional shapes of the respective winding core parts in the samples A1 to A12 are similar to one another.

Simulation results are shown in FIG. 13. The "S1 ratio" in FIG. 13 indicates the area ratio of the winding core part to the winding core part of the sample A1. The "IL" in FIG. 13 indicates the value of insertion loss in the samples in which the number of wire turns is 14. The "IL ratio" in FIG. 13 indicates the ratio of insertion loss to the insertion loss in the sample A1.

Figure 14:
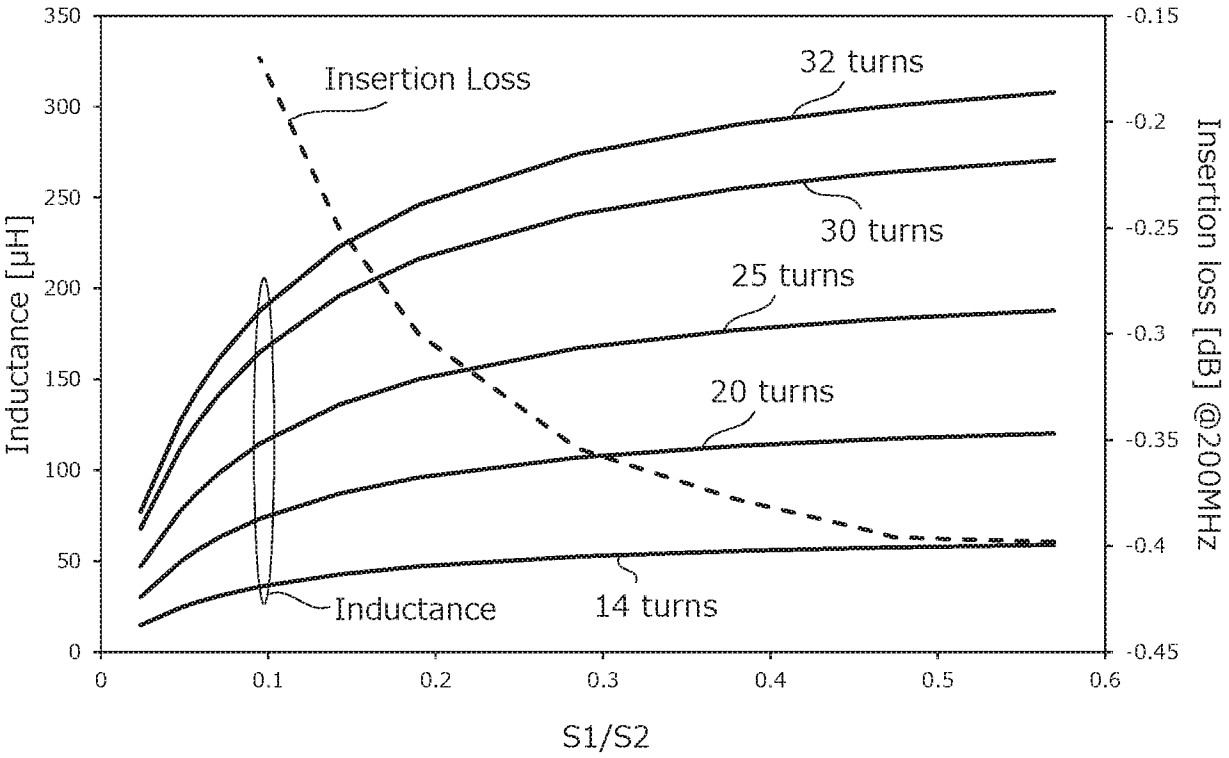
FIG. 14 is a graph illustrating the relationship between the value of S1/S2 and insertion loss and the relationship between the value of S1/S2 and inductance.

FIG. 14 is a graph illustrating the relationship between the value of S1/S2 and insertion loss and the relationship between the value of S1/S2 and inductance, in which the values in FIG. 13 are plotted. As illustrated in FIG. 14, the insertion loss becomes less as the value of S1/S2 is smaller; however, there is almost no difference between the insertion loss in the sample A1 (S1/S2=0.57) and that in the sample A2 (S1/S2=0.47).

On the other hand, it can be seen that the insertion loss becomes significantly small when the value of S1/S2 falls below 0.47. The value of S1 in the sample A2 is about 1.43 $mm^2$, so that when the planar size of the drum core is equivalent to that in the samples A1 to A12, S1 may be set to a value less than about 1.43 $mm^2$ in order to significantly reduce the insertion loss.

The insertion loss in the sample A4 (S1/S2=0.38) is reduced by about 5% relative to that in the sample A1, and the insertion loss in the sample A5 (S1/S2=0.28) is reduced by about 10% relative to that in the sample A1. Thus, the value of S1/S2 may be set to 0.38 or less in order to reduce the insertion loss by 5% or more relative to that in a general pulse transformer, and the value of S1/S2 may be set to 0.28 or less in order to reduce the insertion loss by 10% or more.

On the other hand, the inductance becomes lower as the value of S1/S2 is smaller for all the numbers of turns; however, the reduction is not linear. Specifically, the inclination of the inductance curve is gentle in the vicinity of S1/S2=0.47 at which the insertion loss starts changing, and the inclination becomes steeper as the value of S1/S2 is smaller. As compared with the sample A2 (S1/S2=0.47) in which the insertion loss starts reducing, the reduction in the inductance is suppressed to 10% or less in the sample A5 (S1/S2=0.28), and the reduction in the inductance is suppressed to 20% or less in the sample A6 (S1/S2=0.19). Thus, the value of S1/S2 may be set to 0.28 or more in order to suppress the reduction in the inductance to 10% or less relative to the induction in the sample A2 corresponding to the upper limit, and the value of S1/S2 may be set to 0.19 or more in order to suppress the reduction in the inductance to 20% or less. The value of S1 in the sample A5 is about 0.856 $mm^2$, and the value of S1 in the sample A6 is about 0.571 $mm^2$, so that when the planar size of the drum core is equivalent to that in the samples A1 to A12, the value of S1 may be set to about 0.85 $mm^2$ or more in order to suppress the reduction in the inductance to 10% or less, and the value of S1 may be set to about 0.57 $mm^2$ or more in order to suppress the reduction in the inductance to 20% or less.

When the value of S1/S2 is made excessively small, the mechanical strength of the drum core becomes insufficient, making the winding core part more liable to be broken. Thus, the samples A7 to A12 in which the value of S1/S2 is 0.15 or less are impractical.

Next, simulations were carried out assuming samples B1 to B12 having the same configurations as those of the respective samples A1 to A12 except that the thickness S2*x* of the flange part in the x-direction was increased to 1.2 mm. Thus, in all the samples B1 to B12, the area S2 was 4.008 $mm^2$ (=1.2 mm×3.34 mm). The planar size of the drum core was the same as that in the samples A1 to A12. Thus, the length of the winding core part in the x-direction was reduced by the increase in the thickness of the flange part. The number of turns per wire was set to two different values: 20 and 32 in each of the samples B1 to B12.

Simulation results are shown in FIG. 15. As shown in FIG. 15, the inductance values of the samples B1 to B12 are higher than those of their corresponding samples A1 to A12. In particular, in the samples B1 to B5, a higher inductance than that of the sample A1 can be obtained. The value of S1/S2 in the sample B5 is 0.21. On the other hand, the value of S1/S2 is 0.15 or less in the samples B6 to B12. Thus, the samples B6 to B12 are impractical in terms of mechanical strength.

Next, simulations were carried out assuming samples C1 to C12 having the same configurations as those of the respective samples A1 to A12 except that the thickness S2*x* of the flange part in the x-direction was increased to 1.5 mm. Thus, in all the samples C1 to C12, the area S2 was 5.01 $mm^2$ (=1.5 mm×3.34 mm). The planar size of the drum core was the same as that in the samples A1 to A12. Thus, the length of the winding core part in the x-direction was reduced by the increase in the thickness of the flange part. The number of turns per wire was set to two different values: 20 and 32 in each of the samples C1 to C12.

Simulation results are shown in FIG. 16. As shown in FIG. 16, the inductance values of the samples C1 to C12 are higher than those of their corresponding samples B1 to B12. In particular, in the samples C1 to C5, a higher inductance than that of the sample A1 can be obtained. On the other hand, the value of S1/S2 is 0.15 or less in the samples C6 to C12. Thus, the samples C6 to C12 are impractical in terms of mechanical strength.

What is claimed is:

1. A pulse transformer comprising:

a drum core including a winding core part, a first flange part provided at one end of the winding core part in an axial direction, and a second flange part provided at other end of the winding core part in the axial direction;

a plurality of wires wound around the winding core part; and a plate-like core fixed to the drum core so as to face a first surface of the first flange part that is parallel to the axial direction and a second surface of the second flange part that is parallel to the axial direction, wherein a value of S1/S2 is 0.19 or more and 0.47 or less, where an area of the cross section of the winding core part that is perpendicular to the axial direction is S1 and a facing area between the plate-like core and the first or second surface is S2, and wherein the value of S1 is 0.85 $mm^2$ or more and less than 1.43 $mm^2$.

2. The pulse transformer as claimed in claim 1, wherein the value of S1/S2 is 0.38 or less.

3. The pulse transformer as claimed in claim 1, wherein the value of S1/S2 is 0.21 or more.

4. The pulse transformer as claimed in claim 1, wherein the drum core has a length of 3 mm or more and 5 mm or less in the axial direction and a width of 3 mm or more and 4 mm or less in a first direction crossing the axial direction and parallel to the first and second surfaces.

5. The pulse transformer as claimed in claim 4, further comprising:

a pair of primary-side signal terminals and a secondary-side center tap which are formed on the first flange part; and a pair of secondary-side signal terminals and a primary-side center tap which are formed on the second flange part, wherein one end of each of the plurality of wires is connected to any one of the pair of primary-side signal terminals and the secondary-side center tap, and wherein other end of each of the plurality of wires is connected to any one of the pair of secondary-side signal terminals and the primary-side center tap.

6. The pulse transformer as claimed in claim 1, wherein a height of the winding core part in a second direction perpendicular to the first and second surfaces is larger than a width of the winding core part in a first direction crossing the axial direction and the second direction.

7. A pulse transformer comprising:

a first core including a winding core part and a flange part provided at an end of the winding core part in an axial direction, the flange part having a first surface that is parallel to the axial direction;

a plurality of terminal electrodes provided on the flange part of the first core;

a plurality of wires wound around the winding core part of the first core and connected to the terminal electrodes; and second core fixed to the first core, the second core having a second surface that is parallel to the first surface of the flange part, wherein a height of the winding core part in a second direction perpendicular to the first and second surfaces is larger than a width of the winding core part in a first direction crossing the axial direction and the second direction, and wherein a cross-sectional area of the winding core part that is perpendicular to the axial direction is less than half of an overlapped area of the first and second surfaces viewed from the second direction.

8. The pulse transformer as claimed in claim 7, wherein the cross-sectional area is equal to or less than 0.47 times of the overlapped area.

9. The pulse transformer as claimed in claim 8, wherein the cross-sectional area is equal to or more than 0.19 times of the overlapped area.

10. The pulse transformer as claimed in claim 1, wherein the value of S1/S2 is 0.28 or less.

11. The pulse transformer as claimed in claim 7, wherein the cross-sectional area is equal to or less than 0.28 times of the overlapped area.

12. A pulse transformer comprising:

a drum core including a winding core part, a first flange part provided at one end of the winding core part in an axial direction, and a second flange part provided at other end of the winding core part in the axial direction;

a plurality of wires wound around the winding core part; and a plate-like core fixed to the drum core so as to face a first surface of the first flange part that is parallel to the axial direction and a second surface of the second flange part that is parallel to the axial direction, wherein a value of S1/S2 is 0.19 or more and 0.28 or less, where an area of the cross section of the winding core part that is perpendicular to the axial direction is S1 and a facing area between the plate-like core and the first or second surface is S2.

13. The pulse transformer as claimed in claim 12, wherein a height of the winding core part in a second direction perpendicular to the first and second surfaces is larger than a width of the winding core part in a first direction crossing the axial direction and the second direction.

* * * * *